US006502252B1

(12) United States Patent
Kang

(10) Patent No.: US 6,502,252 B1
(45) Date of Patent: Jan. 7, 2003

(54) TOILET WATER SUPPLY DEVICE

(76) Inventor: Heung-Mook Kang, 103-308, Mido Apt., 766-1, Sangkye-dong, Nowon-gu, Seoul (KR)

( * ) Notice: Subject to any disclaimer, the term of this patent is extended or adjusted under 35 U.S.C. 154(b) by 0 days.

(21) Appl. No.: 09/936,579

(22) PCT Filed: Jan. 14, 2000

(86) PCT No.: PCT/KR00/00023

§ 371 (c)(1),
(2), (4) Date: Sep. 13, 2001

(87) PCT Pub. No.: WO01/51719

PCT Pub. Date: Jul. 19, 2001

(51) Int. Cl.[7] ..... E03D 1/22
(52) U.S. Cl. ..... 4/300; 4/363
(58) Field of Search ..... 4/300, 334, 353, 4/354, 363, 901

(56) References Cited

U.S. PATENT DOCUMENTS

| | | | | | |
|---|---|---|---|---|---|
| 665,887 | A | * | 1/1901 | Emery | 4/363 |
| 1,316,715 | A | * | 9/1919 | Haas | 4/363 |
| 1,396,400 | A | * | 11/1921 | Bresson | 4/363 |
| 2,182,980 | A | * | 12/1939 | Bruzenak | 4/363 |
| 3,566,416 | A | * | 3/1971 | Altieri et al. | 4/363 |
| 4,115,883 | A | * | 9/1978 | Dauvergne | 4/353 |
| 4,266,304 | A | | 5/1981 | Kohrn et al. | 4/415 |
| 4,764,996 | A | | 8/1988 | Pino | 4/415 |
| 5,115,521 | A | * | 5/1992 | Adamides | 4/354 |
| 5,406,652 | A | * | 4/1995 | Hennessy | 4/354 |

FOREIGN PATENT DOCUMENTS

| | | | | |
|---|---|---|---|---|
| GB | 2 200 729 | * | 8/1988 | 4/901 |
| JP | 25440 | * | 2/1977 | 4/353 |

* cited by examiner

*Primary Examiner*—Charles R. Eloshway
(74) *Attorney, Agent, or Firm*—McDonnell Boehnen Hulbert & Berghoff

(57) ABSTRACT

Disclosed is a water supplying and draining apparatus for preventing water leakage. A feed pipe supplies water, which is introduced from an outside water source to the toilet bowl. A reservoir tank receives the washing water, the reservoir being made of an extendable and contractible material, the reservoir having a plurality of branch pipes. A valve opens an opening or shuts the branch pipes in order to provide the water, which is supplied from the outside water source through the feed pipe, to the branch pipe. An expandable protecting cover attaches to an outer surface of the reservoir tank, wherein the other ends of the branch pipes fluidly connects with the valve which is arranged at positions outside of the reservoir tank. One end of the feed pipe fluidly connects with the toilet bowl and the other end of the feed pipe communicates with the valve. One end of the exhaust pipe fluidly connects with the valve and the other end of the exhaust pipe fluidly connects with the toilet stool.

5 Claims, 5 Drawing Sheets prior. art

TOILET WATER SUPPLY DEVICE

TECHNICAL FIELD

The present invention relates to a water supply and drain apparatus for a toilet bowl, and more particularly, to prevent leakage of valve mechanism and noise of water supply.

BACKGROUND ART

A conventional form of toilet bowl for flush reducing is shown in FIG. 1. A toilet bowl comprises a toilet housing 100, a toilet tank 200 for storing washing water, a handle part 300 supplying the washing water into the toilet housing 100. The toilet tank 200 is connected with an introduction pipe 120, in which the washing water is stored. A valve instrument 400 is mounted at the internal of the toilet tank 200 for blocking the supply as the washing water is sufficiently filled. The handle part 300 interlocks with the valve instrument 400. The valve instrument 400 comprises a ball valve 420, a refill tube 440, a saver tube 460, a discharge valve 480 and a flapper valve 500. The handle part 300 comprises a handle 320, a lever 340 raising with handspikes, and a chain 360 connecting at the lever 340 in order to open the discharge valve 480.

The above-described conventional water supply and discharge apparatus for a toilet bowl is operated as below.

An intake pipe 120 is receives washing water through a saver tube 460 into the toilet tank 200. A flapper valve 500 operates a ball valve 420 by flapping along the surface of water. A ball valve 420 is connected at the intake pipe 120 so as to open and close a refill tube 440. Then, a refill tube 440 is closed by the ball valve 420 and the toilet tank 200 is sufficiently filled with the washing water.

When a handle 320 is operated by a user, the handle 320 lifts the chain 360 connecting to the discharge valve 480 which opens and closes a discharge outlet 600 which is connected between a toilet housing 100 and a toilet tank 200. Thereby, a discharge valve 480 is opened by chain 360 and the washing water flows into a toilet housing 100 from toilet tank 200. The washing water flushes out a waste material from a toilet housing 100.

After the washing water is discharged from a toilet housing 100, the discharge valve 480 closes a discharge outlet 600. Then the flapper valve 500 dropps along to the surface of water in the toilet tank 200 and opens the refill tube 440. The washing water is flows into the toilet tank 200 through intake pipe 120.

In the above-described conventional water supply and discharge apparatus for a toilet bowl, the toilet tank 200 receives a washing water having an hydraulic pressure in proportion to capacity of the toilet tank 200, thereby generating noise by high hydraulic pressure.

There are some disadvantages associated with the prior water supply and discharge apparatus for a toilet bowl given as below. That is, precision of the valve instrument 400 may cause waterproofing trouble. As a result, users have a lot of difficulty.

As a prior art to deal with the aforementioned disadvantages, U.S. Pat. No. 5,855,025, issued Jan. 5, 1999 is disclosed, which reduces generated noise and controlled a quantity of use when the washing water flows into the toilet tank, to which is supplied storage water through "T", shaped tube and then directly poured into the flapper valve, thereby the storage water overflows and changes.

There is problem in that the prior art has reduced durability according to complex elements and requires precision in design of the elements.

DISCLOSURE OF INVENTION

It is an object of the present invention to prevent leakage of washing water by supplying water that is properly sealed.

It is a further object of the present invention to minimize noise generated by water supply and drain by supplying water to the storage.

BRIEF DESCRIPTION OF DRAWINGS

This invention will be better understood and its various objects and advantages will be more fully appreciated from the following description taken in conjunction with the accompanying drawings, in which.

BEST MODE FOR CARRYING OUT THE INVENTION

Figure 1:
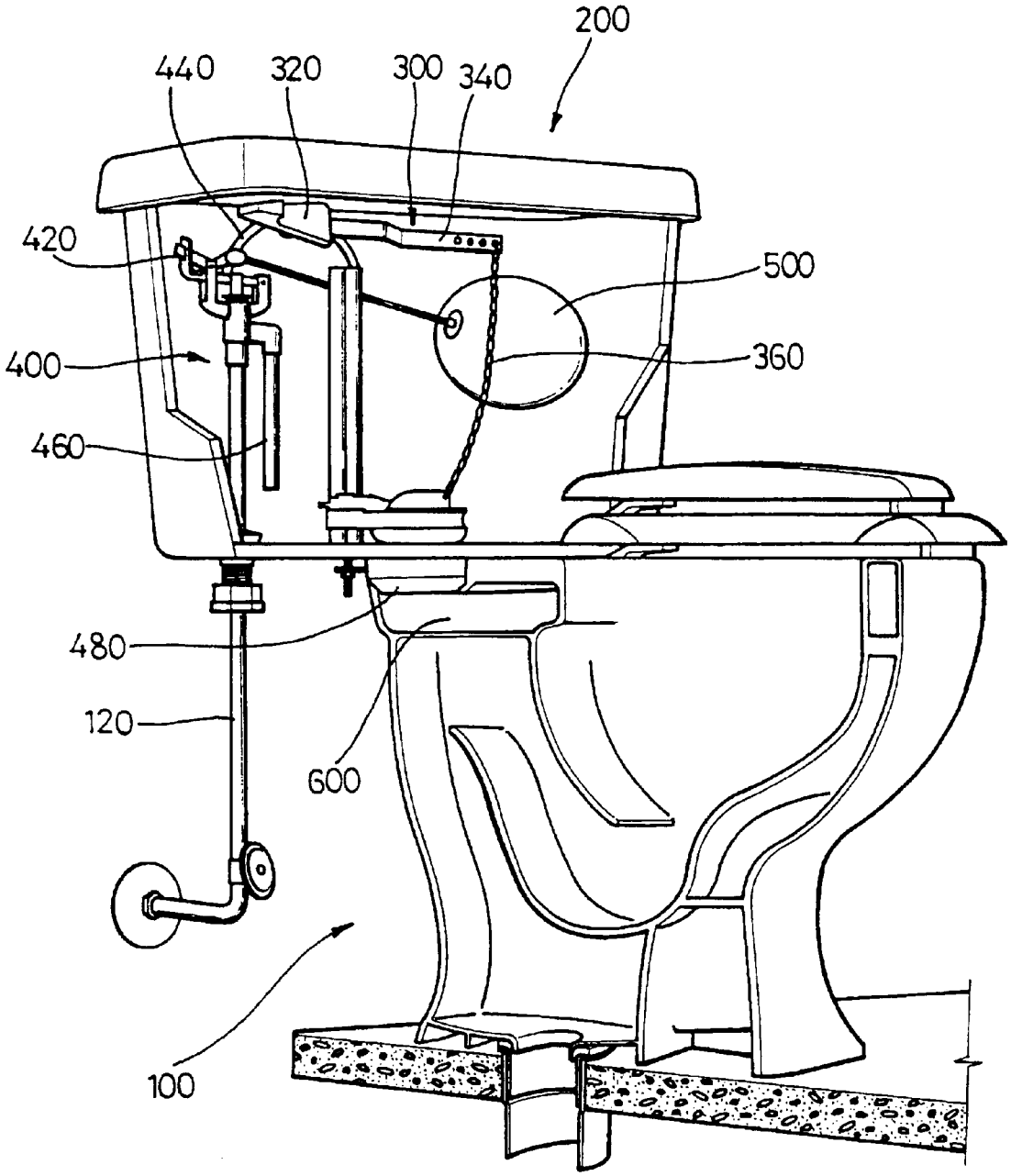
FIG. 1 is a perspective view of a conventional water supplying and draining apparatus for a toilet bowl with parts broken away.
Figure 2:
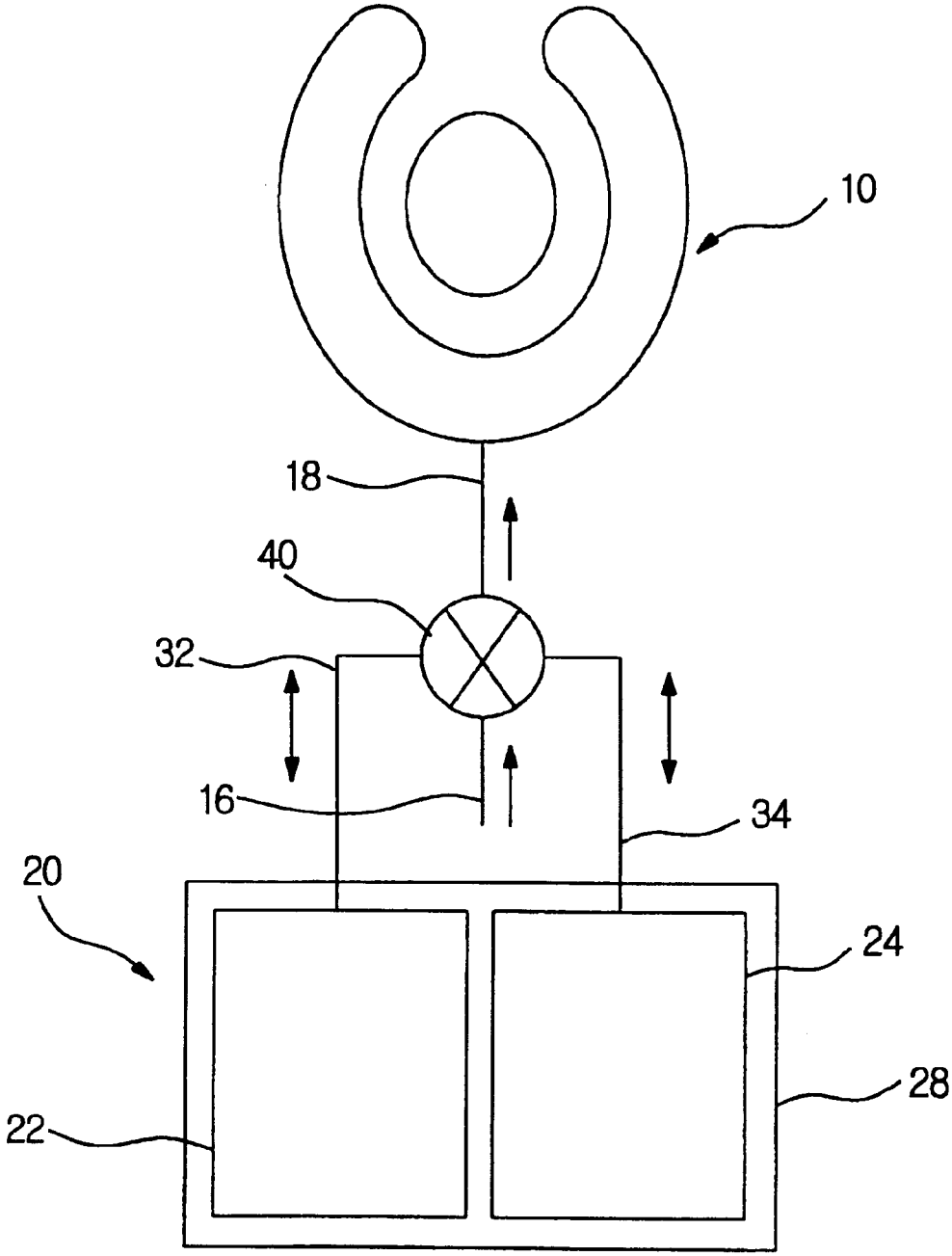
FIG. 2 is a schematic diagram of water supplying and draining apparatus for a toilet bowl according to the present invention.

Hereinafter, this invention will be described in detail with reference to the drawings. FIG. 2 is a schematic diagram of water supply and drain apparatus for a toilet bowl according to the present invention. As shown in the drawing, the apparatus comprises a feed pipe 16, a reservoir tank 20, a valve 40 and a protecting cover 28. The feed pipe 16 supplies washing water, which is introduced from an outside water source, to the toilet bowl. The reservoir tank 20, which is made of an expandable and contractible material, receives the washing water. The reservoir tank 20 has a plurality of branch pipes of which one end of each of the branch pipes is in fluid connection with the reservoir tank 20.

Figure 3A:
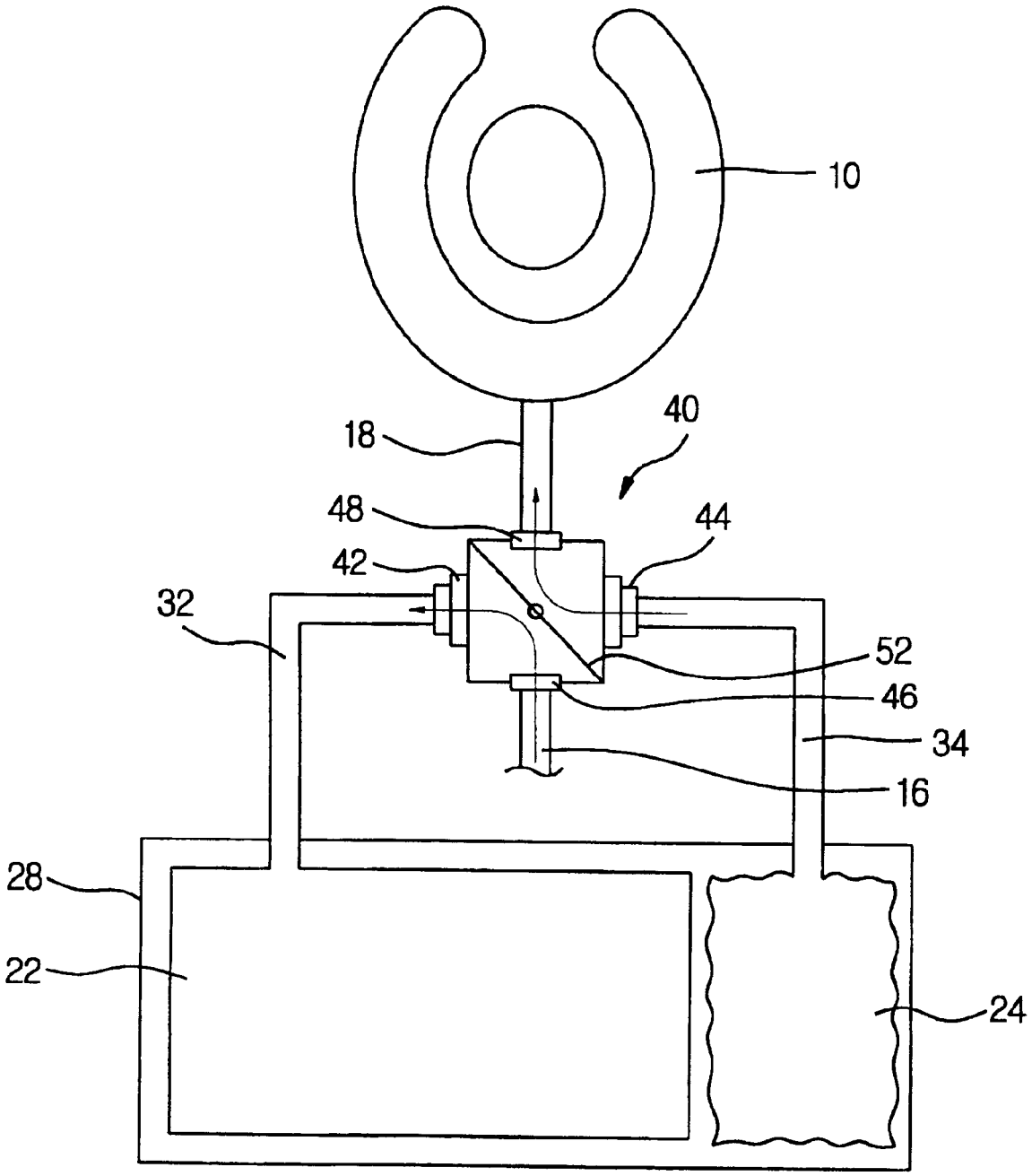
FIG. 3A, FIG. 3B shows water supply and drain apparatus for a toilet bowl of FIG.2 in an operation condition.
Figure 3B:
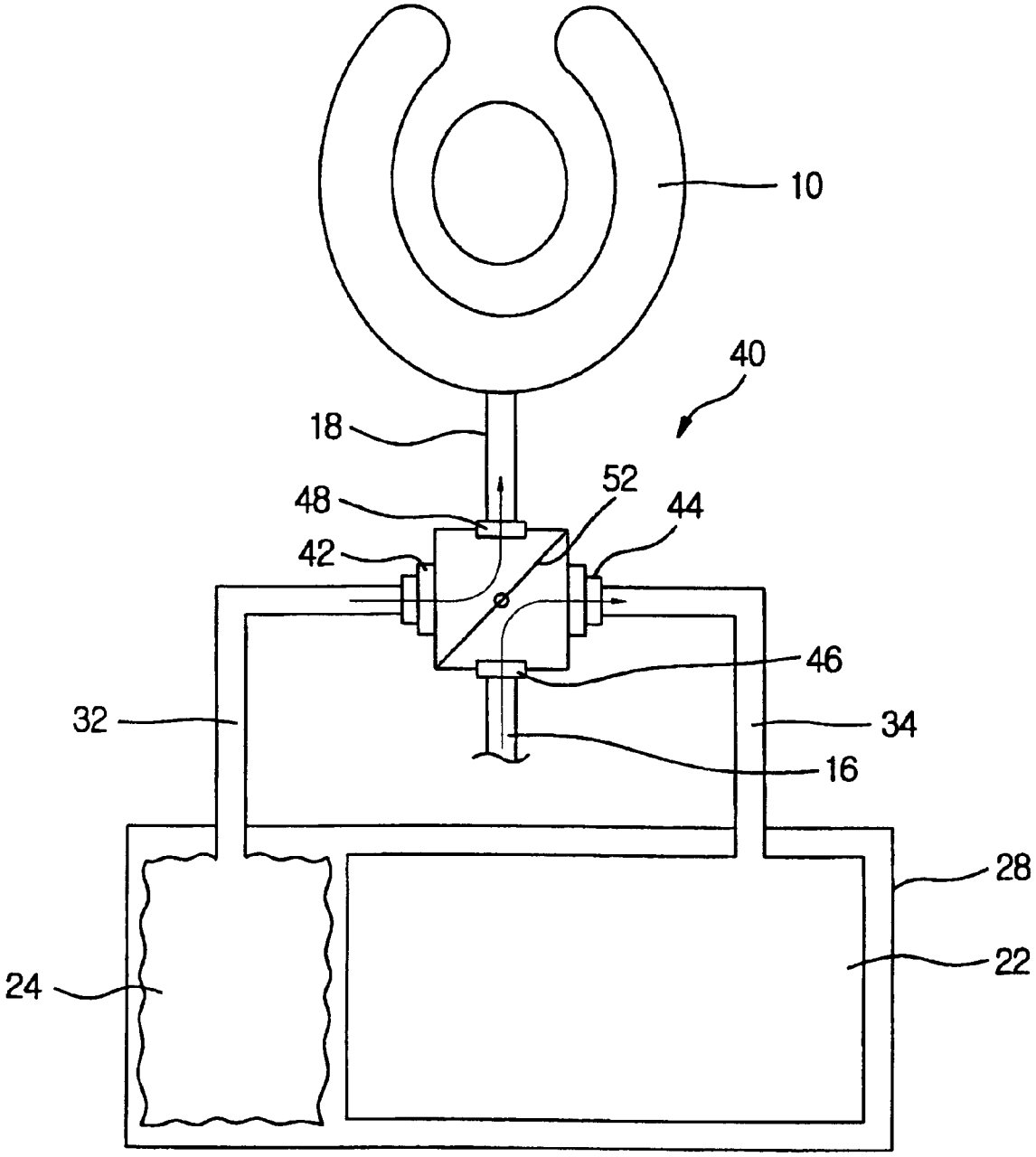
Figure 4:
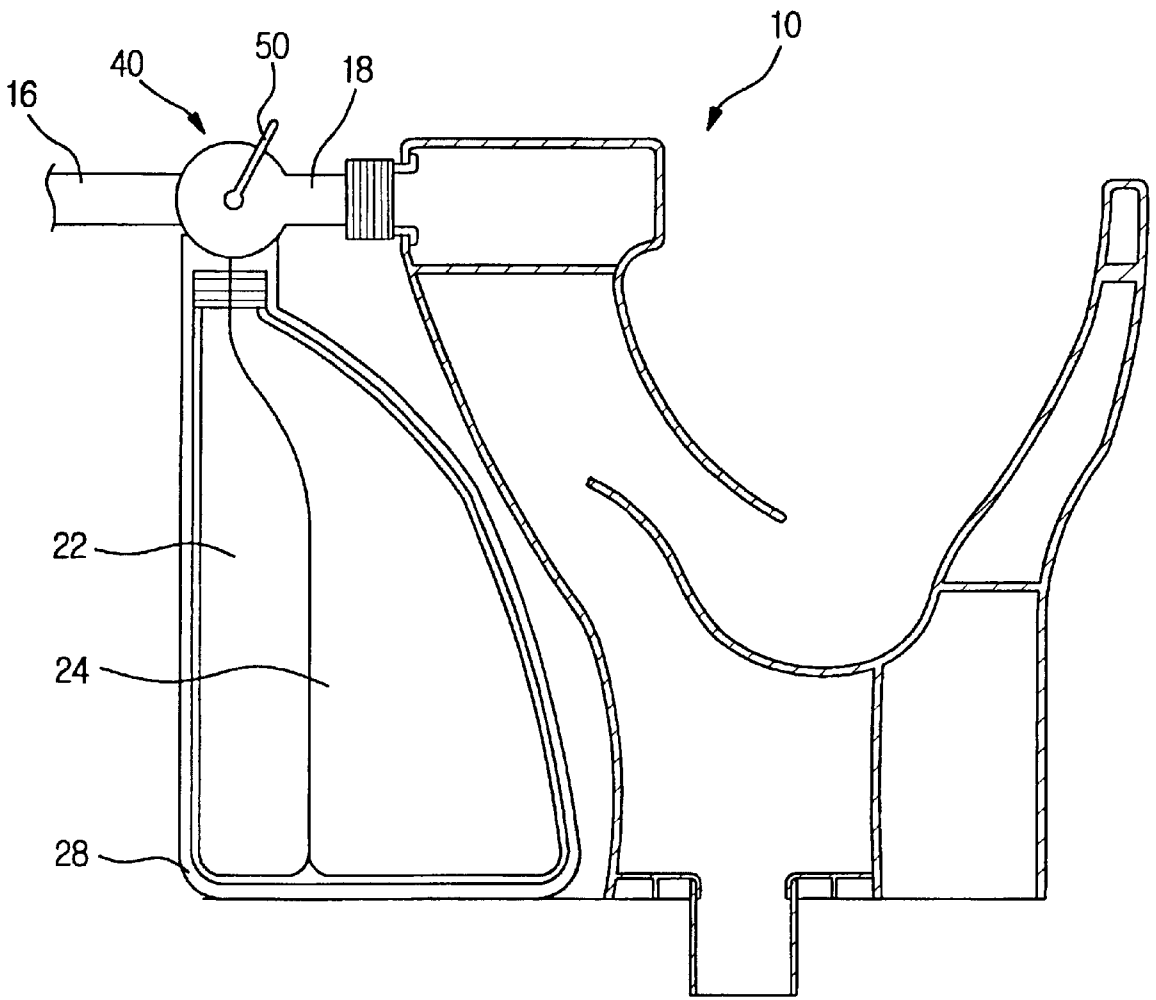
FIG. 4 is a side view of water supply and drain apparatus for a toilet bowl according to the present invention.

FIG. 3A and FIG. 3B show water supply and drain apparatus for a toilet bowl of FIG. 2 in an operational condition. As shown in FIGS. 3*a* and 3*b,* the reservoir tank 20 includes a first chamber 22 and a second chamber 24. The first chamber 22 has a first branch pipe 32 among the plurality of branch pipes. One end of the first branch pipe 32 is in fluid connection with the reservoir tank 20, and thus the first branch pipe 32 can introduce the washing water into the first chamber 22. The second chamber 24 has a second branch pipe 34 among plurality of branch pipes. One end of the second branch pipe 34 is in fluid connection with the second chamber 22, and the second branch pipe 34 can introduce the washing water into the second chamber 24.

The first chamber 22 and the second chamber 24 can be made of a soft rubber, which can expand due to the hydraulic pressure of water. Thus, the chambers can expand when filled with water. When water drains from the first chamber 22 or second chamber 24, the respective chamber can then contract. Therefore, each of the first chamber 22 and the second chamber 24 is capable of repeatedly expanding and contracting.

A valve 40 opens and shuts the branch pipes 32, 34 in order to provide the water, which is supplied from the outside water source through the feed pipe 16, to the branch pipes 32, 34. The valve 40 comprises an exhaust port 48, a feed port 46, a first port 42, a second port 44, a valve membrane 52 and a valve assembly. The exhaust port 48 is in fluid connection with the exhaust pipe 18. The feed port 46 is in fluid connection with the feed pipe 16. The first port 42 is in fluid connection with one end of the first branch pipe 32. The second port 44 is in fluid connection with one end of the second branch pipe 34. The valve membrane 52 is in fluid connection with the feed port 46, the first port 42 and the second port 44. The valve membrane 52 can thus simultaneously open the exhaust port 48 and the feed port 16. The valve assembly can have a flush handle 50 mounted at the valve membrane 52.

A second end of each of the branch pipes is in fluid connection with the valve 40 arranged at positions outside of the reservoir tank 20. A first end of the feed pipe 16 is in fluid connection with the outside water source and a second end of the feed pipe 16 is in fluid connection with the valve 40. A first end of the exhaust pipe 18 is in fluid connection with the valve 40 and a second end of the exhaust pipe 18 is in fluid connection with the toilet stool 10.

A protecting cover 28 is attached to an outer surface of the reservoir tank 20. The protecting cover 28 can be made of a hard rubber capable of expanding due to hydraulic pressure of water during the filling of the reservoir tank 20 with water.

The operation and effect of a water supplying and draining apparatus for a toilet bowl having an exhaust pipe for supplying water to a toilet stool according to the present invention constructed as above will be described below. The first branch pipe 32 and the second branch pipe 34 are in fluid connection with valve 40. Also, the feed pipe 16 and exhaust port 48 are in fluid connection with valve 40. Washing water is supplied from an outside water source into the first chamber 22 or the second chamber through the feed pipe 16. When water is discharged into the exhaust pipe 18 from the first chamber 22, the washing water is supplied into the second chamber 24. The first chamber 22 discharges the washing into the toilet stool 10 through the discharge pipe 18, which gradually contracts by increasing volume of the washing water which is received in the second chamber 24.

A valve assembly opens or shuts the first branch pipe 32 and second branch pipe 34 in order to provide the water to the first chamber 22 and second chamber 24. The valve membrane 52 turns to the position indicated in FIG. 3*a* whereupon the feed port 46 connects with the first port 42, and the exhaust port 48 connects with the second port 44. Washing water, which is introduced from an outside source, is only supplied into the first chamber 22. At that time, the washing water, which is stored into the second chamber 24, is supplied through the exhaust port 48 and exhaust pipe 18 to the toilet stool 10.

The valve membrane 52 turns to the position indicated in FIG. 3*b* whereupon the feed port 46 connects with the second port 44 and the exhaust port 48 connects with the first port 42. Water, which is introduced from an outside source, is only supplied into the second chamber 24. At that time, the washing water, which is supplied into the first chamber 22, is discharged through the exhaust port 48 to the exhaust pipe 18.

When the valve membrane 52 turns to the position indicated in FIG. 3*a,* the washing water is provided to the first chamber 22 since the feed port 46 connects with the first port 42. Then, the first chamber 22 expands while the second chamber 24 contracts.

When a user turns the flush handle 50 in the counter-clockwise rotation, the valve membrane 52 rotates the same. The exhaust port 48 connects with the first port 42 while the feed port 46 connects with the second port 44. The washing water of the first chamber 22 drains into the toilet 10 through the exhaust pipe 18 via the exhaust port 48 which connects with the first port 42. As the washing water drains from the first chamber 22, the first chamber 22 contracts. Water, which is supplied from the feed pipe 16, is supplied into the second chamber 24. As the second chamber 24 fills with water, it expands due to the hydraulic pressure of the water.

As the second chamber 24 expands, the first chamber 22 easily and quickly contracts. This easily discharges the washing water of first chamber 22 into the toilet stool 10. When the second chamber 24 expands and closely adheres to the protecting cover 28, the protecting cover 28 prevents expansion of the second chamber 24. Therefore, the supply of water to reservoir tank 20 is cut off through the feed pipe 16.

When a user turns the flush handle 50 in the clockwise rotation, the valve membrane 52 rotates in the opposite direction, as will be described below. The feed port 46 connects with the first port 42 while the exhaust port 48 connects with the second port 44. The washing water from the first chamber 22 is discharged to the toilet stool 10. The second chamber 24 contracts. Meanwhile, water which is introduced from an outside water source is supplied into the first chamber 22 by means of the feed pipe 16. Therefore, the second chamber 24 contracts while the first chamber 22 expands. Accordingly as the valve 40 is selectively turned, each of the first chamber 22 and the second chamber 24 is repeatedly expands and contracts.

Water, which is supplied from outside water source, is discharged into the first chamber 22 and second chamber 24 which are contracting. When the water is supplied, noise is repressed by the meeting and collision of water, which prevents noise by extending and contracting due to closely adhering to the first chamber 22 and second chamber 24. Because water is supplied into the first chamber 22 and second chamber 24 in the sealed state, water leakage is prevented during supplying the chambers 22, 24 with the washing water.

Additionally, the first chamber 22 and second chamber 24 can be mounted to inner parts of the toilet stool 10. In effect, this can minimize the space necessary for installation, and it can increase the allowable area.

While this invention has been particularly shown and described with reference to particular embodiments thereof, it will be understood by those skilled in the art that various changes in form and details may be effected therein without departing from the spirit and scope of the invention as defined by the appended claims.

What is claimed is:

1. An apparatus for supplying and draining water through an exhaust pipe to and from a toilet bowl, the apparatus comprising:

a feed pipe for supplying the washing water from an outside water source to the toilet bowl;

a reservoir tank for receiving the water, wherein the reservoir tank is comprised of an expandable and contractible material, wherein the reservoir tank has a plurality of branch pipes of which a first end of each of the branch pipes is in fluid connection with the reservoir tank;

a valve for opening and shutting the branch pipes in order to provide the branch pipes with the washing water supplied from the outside water source through the feed pipe;

an expandable protecting cover attached to an outer surface of the reservoir tank, wherein the expandable protecting cover is made of a hard rubber capable of expanding due to hydraulic pressure of water during filling of the reservoir tank; and wherein a second end of each of the branch pipes operably connects with the valve arranged at positions outside of the reservoir tank, wherein a first end of the feed pipe is in fluid connection with the outside water source and a second end of the feed pipe is in fluid connection with the valve, wherein a first end of the exhaust pipe is in fluid connection with the valve, and wherein a second end of the exhaust pipe is in fluid connection with the toilet bowl.

2. The water supplying and draining apparatus as claimed in claim 1, wherein the reservoir tank comprises:

a first chamber having a first branch pipe among the branch pipes, wherein the first branch pipe guides the washing water into the first chamber, and a first end of the first branch pipe is in fluid connection with the reservoir tank;

a second chamber having a second branch pipe among the branch pipes, wherein the second pipe guides the washing water into the second chamber, and wherein a first end of the second branch pipe is in fluid connection with the first chamber; and wherein each of the first chamber and the second chamber is capable of repeatedly expanding and contracting in response to the hydraulic pressure.

3. The water supplying and draining apparatus as claimed in claim 2, wherein the first chamber and the second chamber are made of a soft rubber capable of expanding due to the hydraulic pressure of water during the filling of the respective chamber with water.

4. The water supplying and draining apparatus as claimed in claim 2, wherein the valve comprises:

an exhaust port in fluid connection with the exhaust pipe;

a feed port in fluid connection with the feed pipe;

a first port in fluid connection with the first branch pipe of the first chamber;

a second port in fluid connection with the second branch pipe of the second chamber;

a valve membrane in fluid connection with the feed port, the first port and the second port, wherein the valve membrane can simultaneously open the exhaust port and the feed port; and a valve assembly having a flush handle which is mounted to the valve membrane.

5. A water supplying and draining apparatus using an exhaust pipe to supply water for a toilet bowl, the apparatus comprising:

a feed pipe for supplying washing water from an outside water source to the toilet bowl;

a reservoir tank having a first chamber and a second chamber, the reservoir having a plurality of branch pipes of which a first end of the branch pipes is in fluid connection with the reservoir tank;

a valve for opening or shutting the branch pipes in order to provide the water, which is supplied from the outside water source through the feed pipe, to the branch pipes;

an expandable protecting cover attached to an outer surface of the first chamber and the second chamber, wherein the expandable protecting cover is made of a hard rubber capable of expanding due to hydraulic pressure of water during filling of the reservoir tank;

wherein the first chamber independently expands by receiving water therein from the outside water source through the feed pipe, wherein the second chamber independently expands by receiving water therein from the outside water source through the feed pipe, wherein if water filled in the first chamber is discharged from the first chamber toward the toilet stool due to operation of the valve and thereby the first chamber is contracted, then water is introduced from the outer water source through the feed pipe to the second chamber and thereby the second chamber simultaneously expands during contracting of the first chamber; and wherein a second end of the branch pipes is in fluid connection with the valve arranged at positions outside of the reservoir tank, wherein a first end of the feed pipe is in fluid connection with the outside water source and wherein a second end of the feed pipe is in fluid connection with the valve, wherein a first end of the exhaust pipe is in fluid connection with the valve, and wherein a second end of the exhaust pipe is in fluid connection with the toilet bowl.

* * * * *